US006977003B2

(12) United States Patent
Lim et al.

(10) Patent No.: US 6,977,003 B2
(45) Date of Patent: Dec. 20, 2005

(54) CYCLONE DUST-COLLECTING APPARATUS OF VACUUM CLEANER

(75) Inventors: Jong-Kook Lim, Gwangju (KR); Keon-Soo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 131 days.

(21) Appl. No.: 10/664,492

(22) Filed: Sep. 18, 2003

(65) Prior Publication Data

US 2004/0237482 A1 Dec. 2, 2004

(30) Foreign Application Priority Data

Jun. 2, 2003 (KR) ..... 10-2003-0035210

(51) Int. Cl.[7] ..... B01D 50/00; B01D 45/12

(52) U.S. Cl. ..... 55/337; 55/426; 55/428; 55/449; 55/459.1; 55/459.2

(58) Field of Search ..... 55/337, 426, 428, 55/449, 459.1, 459.2, 459.3, 457, 503, DIG. 3

(56) References Cited

U.S. PATENT DOCUMENTS

| | | | | |
|---|---|---|---|---|
| 5,307,538 | A | 5/1994 | Rench et al. | 15/352 |
| 6,406,505 | B1 * | 6/2002 | Oh et al. | 55/337 |
| 6,558,453 | B2 * | 5/2003 | Sepke et al. | 95/268 |
| 2002/0166310 | A1 | 11/2002 | Bilek et al. | 55/337 |
| 2002/0194993 | A1 | 12/2002 | Gen | 95/268 |

FOREIGN PATENT DOCUMENTS

| | | |
|---|---|---|
| FR | 1 094 603 | 12/1953 |
| FR | 2 812 531 | 11/2000 |
| GB | 2 384 452 | 7/2003 |
| GB | 2 397 785 | 8/2004 |
| WO | WO 01/60226 | 8/2001 |

OTHER PUBLICATIONS

Search report based on British Patent Application No. 2003-35210 dated on Sep. 2, 2004.
French Search Report received Jan. 14, 2005.

* cited by examiner

*Primary Examiner*—Robert A. Hopkins
(74) *Attorney, Agent, or Firm*—Ohlandt, Greeley, Ruggiero & Perle, LLP.

(57) ABSTRACT

A cyclone dust-collecting apparatus comprises an upper casing having an air suction port formed thereon, a lower casing connected to the upper casing to form a cyclone chamber, a guide unit disposed between the upper and the lower casing, and having a first channel for swirling a dirt-laden air drawn in through the air suction port, and a second channel for discharging a cleaned air therethrough; and a filter assembly mounted between the guide unit and the lower casing, for removing a dirt and a dust from the air as drawn in. Accordingly, a compact-sized cyclone dust-collecting apparatus is realized and maintenance management of the vacuum cleaner becomes easy.

20 Claims, 4 Drawing Sheets

CYCLONE DUST-COLLECTING APPARATUS OF VACUUM CLEANER

BACKGROUND

1. Field of the Invention

The present invention relates to a cyclone dust-collecting apparatus of a vacuum cleaner, and more particularly, to a cyclone dust-collecting apparatus having an improved opening/closing structure and having dust-collecting chambers at both sides thereof.

2. Description of the Related Art

Generally, a cyclone dust-collecting apparatus separates and collects dirt from dirt-laden air by using a centrifugal force and discharges cleaned air to the outside. Such a cyclone dust-collecting apparatus is usually employed in a vacuum cleaner for domestic use.

FIG. 1 is a cross-section view showing an example of a vacuum cleaner employing a general cyclone dust-collecting apparatus. With reference to FIG. 1, the conventional cyclone dust-collecting apparatus and operations thereof will be described below.

As shown in FIGS. 1 and 2, a dust-collecting chamber 2 is partitioned off from a cleaner body 1 by a partition 3 disposed inside the cleaner body 1. In the dust-collecting chamber 2 is uprightly disposed a cyclone body 11 of a cylinder shape. A suction channel 12 is disposed at a side of an upper circumference of the cyclone body 11 so that, once air and dirt are drawn into the cleaner body 1 through a flexible hose 5 by a suction force generated by driving a motor (not shown), such drawn air and dirt are flown into the cyclone body 11 in a tangential direction.

An air discharge channel 13 is disposed on an upper center portion of the cyclone body 11, for upwardly discharging dirt-removed air out of the cyclone body 11. A dirt discharge channel 14 is disposed in a lower center portion of the cyclone body 11, for downwardly discharging the dirt separated from the air drawn into the cyclone body 11.

The dirt discharge channel 14 is connected to a dust-collecting chamber 15 disposed right under the cyclone body 11, for collecting the dirt discharged through the dirt discharge channel 14.

The operations of the cyclone dust-collecting apparatus with the above-described construction will be described below.

As the cyclone dust-collecting apparatus is operated, the motor (not shown) is operated to generate a suction force inside the cyclone body 11. Due to the suction force, dirt is drawn into the cyclone body 11 together with the air through the suction channel 12.

The dirt-laden air drawn into the cyclone body 11 through the suction channel 12 in the tangential direction swirls along an inner wall of the cyclone body 11, thereby generating a centrifugal force.

At this time, since a relatively light air is less subjected to the centrifugal force, it gathers in a central portion of the cyclone body 11, thereby generating a cyclone and forming a flow (a discharge air current) to the air discharge channel 13, so that the air is discharged through the air discharge channel 13.

Meanwhile, dirt which is relatively heavier than the air is more subjected to the centrifugal force, and thus flows along the inner wall of the cyclone body 11 and is collected in the dust-collecting chamber 15 disposed under the dirt discharge channel 14. When the dirt is collected in the dust-collecting chamber 15 more than a predetermined level, a user separates the dust-collecting chamber 15 from the cleaner body 1, empties it, and then re-connects the dust-collecting chamber 15 to the cleaner body 1.

However, the cyclone dust-collecting apparatus with the conventional construction has disadvantages as follows.

First, the dust-collecting chamber 15 must be disposed right under a conical portion of the cyclone body 11.

Accordingly, in case of employing the dust-collecting apparatus in a vacuum cleaner, it is impossible for a user to separate only the dust-collecting chamber 15 from the cyclone body 11 without removing the cyclone body 11 when he/she wishes to empty the dust-collecting chamber 15. Therefore, the vacuum cleaner is inconvenient to use and has a problem in maintenance.

Especially, in case of employing the cyclone dust-collecting apparatus in a canister type vacuum cleaner, since the dust-collecting chamber 15 is disposed right under the cyclone body 11, the cyclone body 11 is firstly required to be separated from the body 1 prior to separating the dust-collecting chamber 15 from the cyclone body 11.

Another disadvantage of the conventional cyclone dust-collecting apparatus is that, due to the height of the dust-collecting apparatus, the total height of a cleaner increase, and it is even worse when the dust-collecting apparatus is employed in a canister type vacuum cleaner or an upright type vacuum cleaner. As a result, it is difficult to realize a compact-sized product.

SUMMARY

The present invention has been developed in order to solve the above problems in the related arts. Accordingly, an aspect of the present invention is to provide a compact-sized cyclone dust collecting apparatus.

Another aspect of the present invention is to provide a cyclone dust-collecting apparatus having an improved opening/closing structure and having a dust collecting chamber easy to be separated for management.

Still another aspect of the present invention is to provide a cyclone dust-collecting apparatus which can be used instead of a conventional dust bag.

The above aspects are achieved by providing a cyclone dust-collecting apparatus comprising an upper casing having an air suction port formed thereon, a lower casing connected to the upper casing to form a cyclone chamber, a guide unit disposed between the upper and the lower casing, and having a first channel for swirling a dirt-laden air drawn in through the air suction port, and a second channel for discharging a cleaned air therethrough; and a filter assembly mounted between the guide unit and the lower casing, for removing a dirt and a dust from the air as drawn in.

Also, it is preferred that the lower casing is provided with a plurality of dust-collecting chambers formed in both sides thereof, for collecting the dust and the dirt separated from the air.

Also, it is preferred that the dust-collecting chambers are partitioned off from the cyclone chamber by a partition, and the partition has a connecting port for allowing the dust and the dirt to move therethrough.

Also, it is preferred that the guide unit comprises an upper guide member having a first opening to closely contact with the air suction port of the upper casing and a first duct, and a lower guide member connected to the upper guide member and having a second opening and a second duct. The first opening and the second duct form the first channel and the first duct and the second opening form the second channel.

Also, it is preferred that, on a side of the upper casing is disposed a recess corresponding to an end of the first duct, and the recess allows the air flowing through the first duct to be discharged to the outside therethrough. Preferably, the second duct is shaped in a spiral.

Also, it is preferred that the filter assembly comprises a grill for filtering out the dust and the dirt of the air and a supporting frame for supporting the grill.

At this point, it is preferred that the filter assembly further comprises an upper frame connected to an upper end of the grill at one side, and connected to the second opening at the other side, and a lower frame connected to a lower end of the grill.

Also, it is preferred that the cyclone dust-collecting apparatus further comprises a locking device for securing the upper casing and the lower casing to each other.

It is preferred that the locking device comprises a protrusion formed in a side of the upper casing, and a locking member disposed at a side of the lower casing, and being locked with the protrusion, and the upper casing and the lower casing are hinged on each other at one side. Also, it is preferred that the upper casing is provided with a handle.

Also, it is preferred that between the air suction port of the upper casing and the guide unit is provided a sealing member.

According to another aspect of the present invention, a cyclone dust-collecting apparatus comprises an upper casing having an air suction port formed thereon and a recess formed in a rear portion thereof, a lower casing connected to the upper casing to form a cyclone chamber and having a plurality of dust-collecting chambers, an upper guide member disposed between the upper and the lower casing and having a first opening closely contacting with the air suction port of the upper casing and a first duct, a lower guide member connected to the upper guide member and having a second opening and a second duct; and a filter assembly mounted between the lower guide member and the lower casing, the filter assembly comprising a grill for filtering dirt out of an external air and a supporting frame for supporting the grill. The first opening and the second duct form a first channel and the first duct and the second opening form a second channel.

At this point, it is preferred that the second duct is shaped in a spiral.

Also, it is preferred that the filter assembly further comprises an upper frame connected to an upper end of the grill at one side, and the second opening at the other side, and a lower frame connected to a lower end of the grill.

Preferably, the cyclone dust-collecting apparatus further comprises a locking device for securing the upper casing and the lower casing to each other. The locking device comprises a protrusion formed in a side of the upper casing, and a locking member disposed at a side of the lower casing, and being locked with the protrusion;

Also, it is preferred that the upper casing and the lower casing are hinged on each other at one side, and the upper casing is provided with a handle.

At this point, it is preferred that between the air suction port of the upper casing and the upper guide member is provided a sealing member.

BRIEF DESCRIPTION OF THE DRAWINGS

The above aspects and other features of the present invention will be more apparent by describing a preferred embodiment of the present invention with reference to the accompanying drawings, in which.

DESCRIPTION OF THE PREFERRED EMBODIMENT

Hereinafter, a cyclone dust-collecting apparatus according to a preferred embodiment of the present invention will be described in greater detail with reference to the accompanying drawings.

Figure 1:
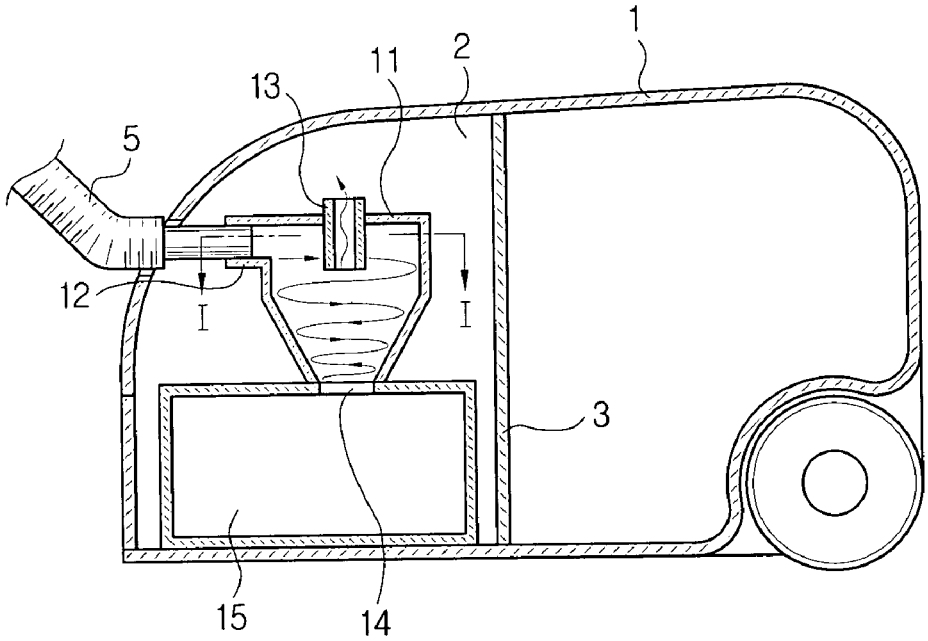
FIG. 1 (PRIOR ART)
FIG. 1 is a schematic cross-section view showing an example of a vacuum cleaner employing a general cyclone dust-collecting apparatus.
Figure 2:
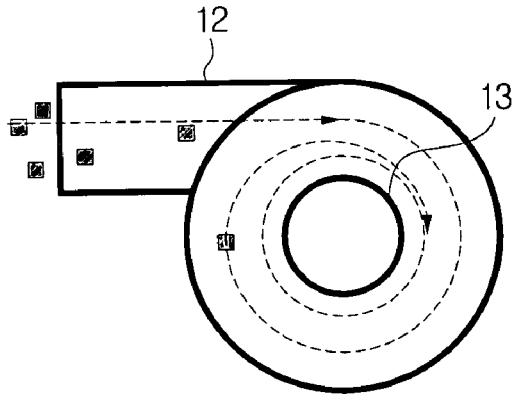
FIG. 2 (PRIOR ART)
FIG. 2 is a cross-section view taken along the line I—I of FIG. 1.
Figure 3:
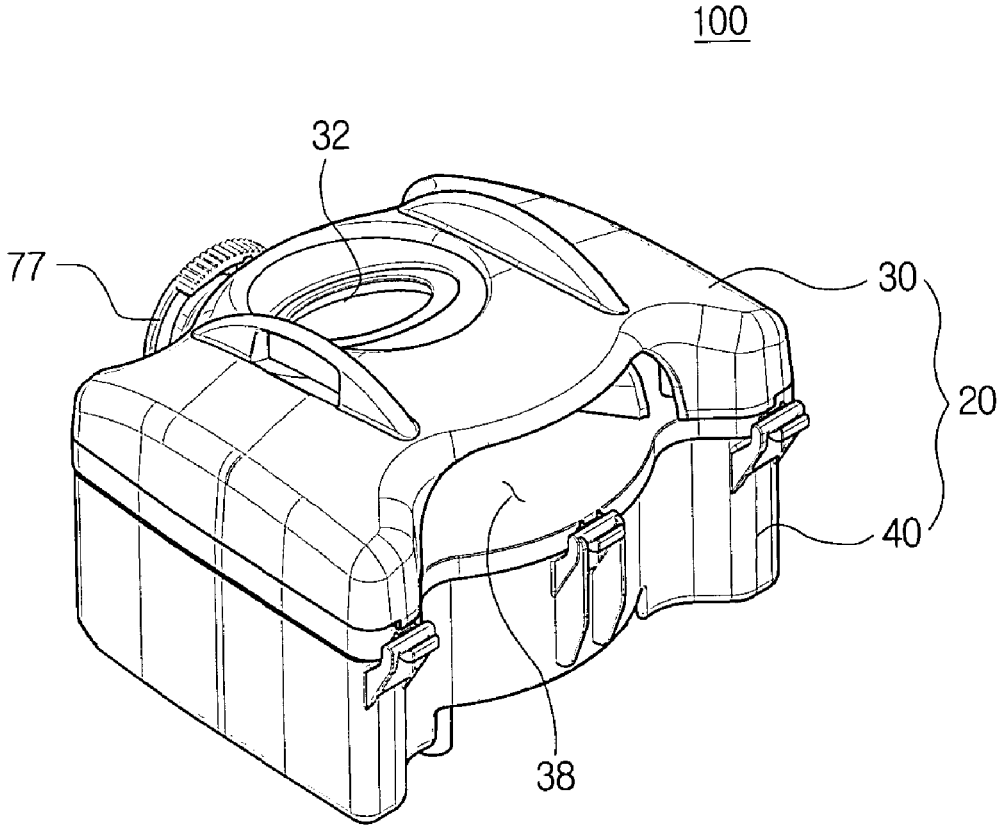
FIG. 3 is a perspective view showing a cyclone dust-collecting apparatus according to a preferred embodiment of the present invention.
Figure 4:
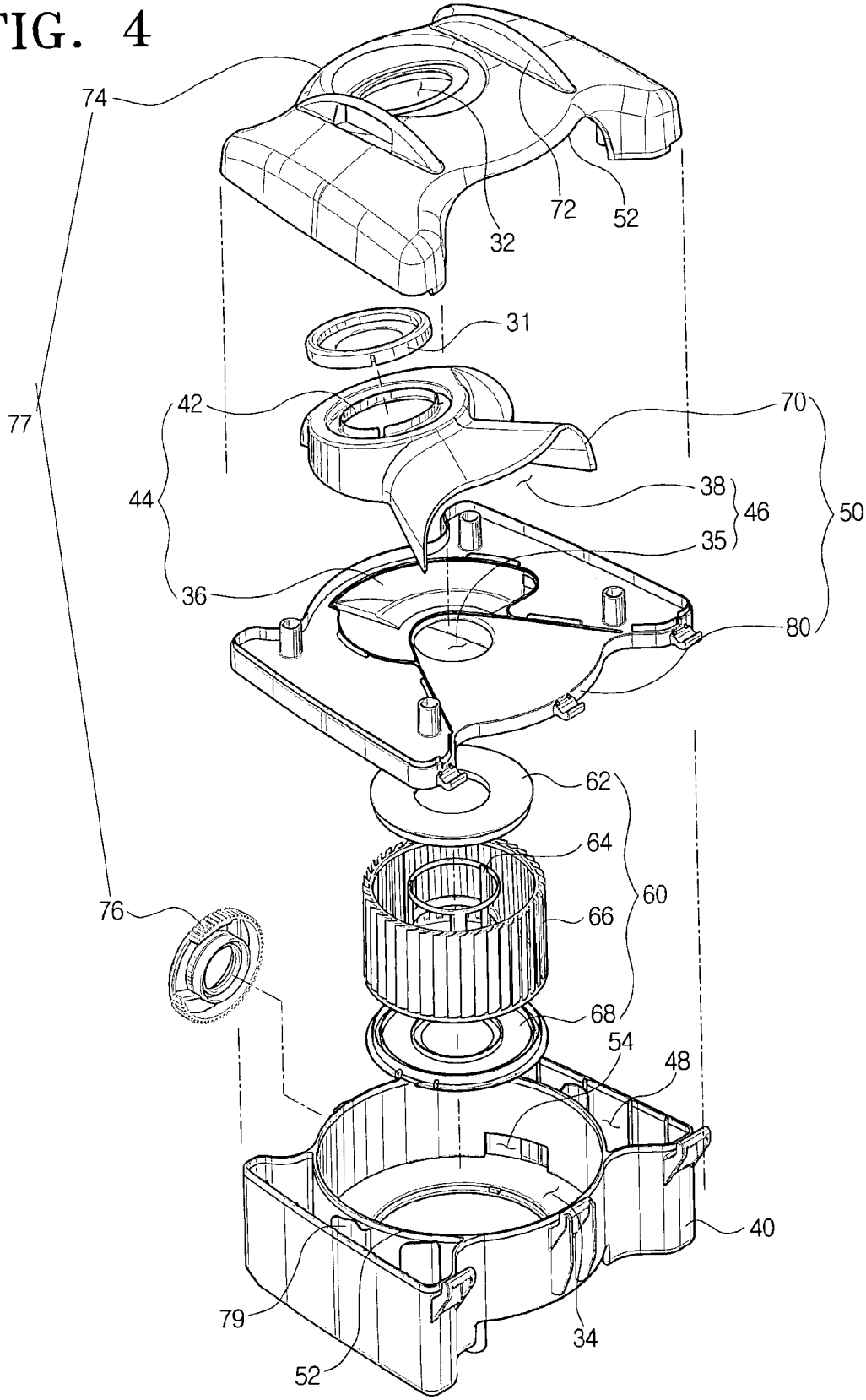
FIG. 4 is an exploded perspective view showing the cyclone dust-collecting apparatus according to the preferred embodiment of the present invention.

FIG. 3 is a perspective view showing a cyclone dust-collecting apparatus according to the preferred embodiment of the present invention, and FIG. 4 is an exploded perspective view showing the cyclone dust-collecting apparatus according to the preferred embodiment of the present invention. As shown in FIGS. 3 and 4, a cyclone dust collecting apparatus 100 includes an upper casing 30 and a lower casing 40 which configure a cyclone body 20, a guide unit 50 disposed between the upper and the lower casings 30 and 40, and a filter assembly 60 mounted between the guide unit 50 and the lower casing 40.

In an upper portion of the upper casing 30 is disposed an air suction port 32, through which air including dust and dirt flows into the cyclone dust-collecting apparatus 100.

Also, the upper casing 30 is provided with a handle 72 for allowing a user to easily separate the dust collecting apparatus 100 from a cleaner body (not shown).

Between the air suction port 32 of the upper casing 30 and the guide unit 50 is disposed a sealing member 31. The sealing member 31 prevents leakage of the air while the dirt-laden air flows from the air suction port 32 of the upper casing 30 to the guide unit 50.

The lower casing 40 is connected to the upper casing 30, to thereby form a cyclone chamber 34 in which the dust and the dirt are separated from the air by a centrifugal force.

Both sides of the lower casing 40 are provided with a plurality of dust-collecting chambers 48 for collecting the dust and dirt separated from the air. Thus, dust and dirt separated in the cyclone dust-collecting apparatus 100 by the centrifugal force are collected in the plurality of dust-collecting chambers 48 from a certain side.

Also, the upper casing 30 and the lower casing 40 are secured to each other by a locking device 77 with one side, and are hinged to each other with the other side. Accordingly, a user easily opens and closes to clean an interior of the cyclone dust-collecting apparatus 100.

The locking device 77 includes a protrusion 74 formed on a side of the upper casing 30 and a locking member 76 disposed on a side of the lower casing 40 to be locked with the protrusion 74. As a user rotates the locking member 76 in one side direction, the locking member 76 is locked or unlocked. The locking member 76 and the protrusion 74 can be modified to various types as far as the modified one properly function to lock and unlock.

The dust-collecting chambers 48 are partitioned off from the cyclone chamber 34 by a partition 52. A connecting port 54 is disposed in the partition 52 for allowing the dust and the dirt to move therethrough. Also, at the connecting port 54 is disposed a guide member 79 toward the dust-collecting chambers 48, for preventing reverse-flowing of the dust and dirt collected in the dust-collecting chambers 48 and facilitating process of collecting dirt and dust.

The guide unit 50 includes an upper guide member 70 and a lower guide member 80 connected to the upper guide member 70.

Also, the upper guide member 70 has a first opening 42 closely contacting with the air suction port 32 of the upper casing 30, and a first duct 38.

The lower guide member 80 has a second opening 35 and a second duct 36. The second duct 36 has a spiral shape.

The fist opening 42 and the second duct 36 form a first channel 44 for swirling the dirt-laden air, and the first duct 38 and the second opening 35 form a second channel 46 for discharging cleaned air out.

Accordingly, dust and dirt drawn in the cyclone dust-collecting apparatus 100 through the first channel 44 are separated by a centrifugal force according to a cyclone process, and the cleaned air is discharged to the first duct 38 through the second channel 46.

Also, a recess 52 is defined in a side of the upper casing 30 in a corresponding shape to an end of the first duct 38 so that the air flowing from the first duct 38 is discharged to the outside through the recess 52.

The filter assembly 60 includes a grill 66 for filtering dirt out of the air, a supporting frame 64 for supporting the grill 66, an upper frame 62 connected to an upper end of the grill 66 at the one side and the second opening 35 at the other side, and a lower frame 68 connected to a lower end of the grill 66.

The dirt-laden air drawn in through the first channel 44 passes through the filter assembly 60, forming a swirl so that the dust and the dirt are separated from the air by a centrifugal force. The cleaned air flows into the grill 66 and then is discharged to the second channel 46 through the upper frame 62.

Figure 5:
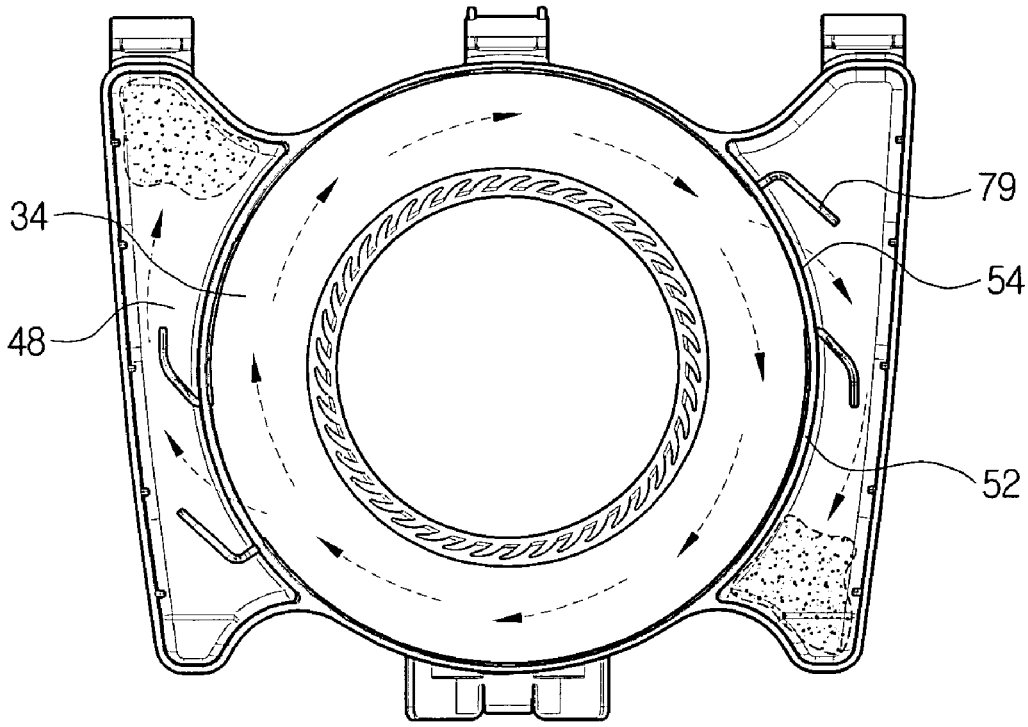
FIG. 5 is a plan view showing the lower casing of the cyclone dust-collecting apparatus according to the preferred embodiment of the present invention.

Referring to FIGS. 3 to 5, the operations of the cyclone dust-collecting apparatus with the above-described construction will be described. FIG. 5 is a plan view showing the lower casing 40 of the cyclone dust-collecting apparatus 100.

As the cyclone dust-collecting apparatus 100 is operated, a motor (not shown) is driven to generate a suction force at the cyclone dust-collecting apparatus 100. Due to the suction force, dirt is drawn into the cyclone body 20 together with an air through the first channel 44.

At this point, the dirt-laden air drawn into the cyclone body 20 in a tangential direction through the first channel 44 swirls along an inner wall of the cyclone body 20, generating a centrifugal force.

Accordingly, a relatively light air is less subjected to the centrifugal force and thus it gathers in a central portion of the cyclone body 20, generating a cyclone. Then the air passes through the grill 66 of the filter assembly 50, forming a flow (a discharge air current), and is discharged through the second channel 46.

Meanwhile, dirt relatively heavier than the air is more subjected to the centrifugal force and thus moves down along the inner wall of the cyclone body 20. As a result, the dirt flows into the plurality of dust-collecting chamber 48 formed in both sides of the lower casing 40 of the cyclone body 20 through the connecting port 54. At this point, the dirt and dust are collected from an opposite side to the connecting port 54 in the dust-collecting chambers 48.

When the dust and the dirt are collected more than a predetermined level in the dust-collecting chamber 48, a user separates the upper casing 30 and the lower casing 40 from each other by manipulating the locking member 76 of the cyclone dust-collecting apparatus 100. Since the upper casing 30 and the lower casing 40 are hinged to each other at the other side of the cyclone body 20, the user easily opens the cyclone dust-collecting apparatus 100, empties it, and reconnects.

As described above, since the cyclone dust-collecting apparatus 100 is opened/closed by a lever type locking device, it provides convenience in cleaning and maintaining interiors thereof.

Also, since the dust-collecting chambers 48 are provided to both sides of the cyclone body 20, total height is reduced. Accordingly, even when the dust-collecting apparatus 100 is employed in a canister type vacuum cleaner, a compact-sized product can be realized.

Also, since the cyclone-dust collecting apparatus 100 can be used instead of a general dust bag, there is an economical effect.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cyclone dust-collecting apparatus comprising:

an upper casing having an air suction port formed thereon;

a lower casing connected to the upper casing to form a cyclone chamber;

a guide unit disposed between the upper and the lower casing, and having a first channel for swirling a dirt-laden air drawn in through the air suction port, and a second channel for discharging a cleaned air therethrough; and a filter assembly mounted between the guide unit and the lower casing, for removing a dirt and a dust from the air as drawn in, wherein the lower casing is provided with a plurality of dust-collecting chambers provided at sides of the cyclone chamber.

2. The cyclone dust-collecting apparatus of claim 1, wherein the dust-collecting chambers are partitioned off from the cyclone chamber by a partition, and the partition has a connecting port for allowing the dust and the dirt to move therethrough.

3. The cyclone dust-collecting apparatus of claim 1, wherein the filter assembly comprises a grill for filtering out the dust and the dirt of the air and a supporting frame for supporting the grill.

4. The cyclone dust-collecting apparatus of claim 3, wherein the filter assembly further comprises an upper frame connected to an upper end of the grill at one side, and connected to the second opening at the other side, and a lower frame connected to a lower end of the grill.

5. The cyclone dust-collecting apparatus of claim 1, further comprising a locking device for securing the upper casing and the lower casing to each other.

6. The cyclone dust-collecting apparatus of claim 5, wherein the locking device comprises:

a protrusion formed in a side of the upper casing; and a locking member disposed at a side of the lower casing, and being looked with the protrusion.

7. The cyclone dust-collecting apparatus of claim 1, wherein the upper casing is provided with a handle.

8. The cyclone dust-collecting apparatus of claim 1, wherein between the air suction port of the upper casing and the guide unit is provided a sealing member.

9. A cyclone dust-collecting apparatus comprising:

an upper casing having an air suction port formed thereon;

a lower casing connected to the upper casing to form a cyclone chamber;

a guide unit disposed between the upper and the lower casing, and having a first channel for swirling a dirt-laden air drawn in through the air suction port, and a second channel for discharging a cleaned air therethrough; and a filter assembly mounted between the guide unit and the lower casing, for removing a dirt and a dust from the air as drawn in, wherein the guide unit comprises:

an upper guide member having a first opening to closely contact with the air suction port of the upper casing and a first duct; and a lower guide member connected to the upper guide member and having a second opening and a second duct, and the first opening and the second duct form the first channel and the first duct and the second opening form the second channel.

10. The cyclone dust-collecting apparatus of claim 9, wherein on a side of the upper casing is disposed a recess corresponding to an end of the first duct, the recess for allowing the air flowing through the first duct to be discharged to the outside therethrough.

11. The cyclone dust-collecting apparatus of claim 9, wherein the second duct is shaped in a spiral.

12. A cyclone dust-collecting apparatus comprising:

an upper casing having an air suction port formed thereon;

a lower casing connected to the upper casing to form a cyclone chamber;

a guide unit disposed between the upper and the tower casing, and having a first channel for swirling a dirt-laden air drawn in through the air suction port, and a second channel for discharging a cleaned air therethrough; and a filter assembly mounted between the guide unit and the lower casing, for removing a dirt and a dust from the air as drawn in, wherein the upper casing and the lower casing are hinged on each other at one side.

13. A cyclone dust-collecting apparatus comprising:

an upper casing having an air suction port formed thereon and a recess formed in a rear portion thereof;

a lower casing connected to the upper casing to form a cyclone chamber and having a plurality of dust-collecting chambers;

an upper guide member disposed between the upper and the lower casing and having a first opening closely contacting with the air suction port of the upper casing and a first duct;

a lower guide member connected to the upper guide member and having a second opening and a second duct; and a filter assembly mounted between the lower guide member and the lower casing, the filter assembly comprising a grill for filtering dirt out of an external air and a supporting frame for supporting the grill, and the first opening and the second duct forming a first channel and the first duct and the second opening forming a second channel.

14. The cyclone dust-collecting apparatus of claim 13, wherein the second duct is shaped in a spiral.

15. The cyclone dust-collecting apparatus of claim 13, wherein the filter assembly further comprises an upper frame connected to an upper end of the grill at one side, and the second opening at the other side, and a lower frame connected to a lower end of the grill.

16. The cyclone dust-collecting apparatus of claim 13, further comprising a locking device for securing the upper casing and the lower casing to each other.

17. The cyclone dust-collecting apparatus of claim 16, wherein the locking device comprises:

a protrusion formed in a side of the upper casing; and a looking member disposed at a side of the lower casing, and being locked with the protrusion.

18. The cyclone dust-collecting apparatus of claim 13, wherein the upper casing and the lower casing are hinged on each other at one side.

19. The cyclone dust-collecting apparatus of claim 13, wherein the upper casing is provided with a handle.

20. The cyclone dust-collecting apparatus of claim 13, wherein between the air suction port of the upper casing and the upper guide member is provided a sealing member.

* * * * *